US006460471B1

(12) United States Patent
Yang

(10) Patent No.: US 6,460,471 B1
(45) Date of Patent: Oct. 8, 2002

(54) MODULAR BASE FOR A MACHINE

(76) Inventor: Sheng-Hui Yang, No. 2, Lane 64, Tung-Kuang-Yuan Rd., Tung Dist., Taichung City (TW)

( * ) Notice: Subject to any disclaimer, the term of this patent is extended or adjusted under 35 U.S.C. 154(b) by 0 days.

(21) Appl. No.: 09/767,782

(22) Filed: Jan. 23, 2001

(51) Int. Cl.[7] ..... A47B 9/00
(52) U.S. Cl. ..... 108/156; 248/188
(58) Field of Search ..... 108/156, 153.1, 108/157.1, 158, 158.12, 180, 189, 193; 248/188.1, 188

(56) References Cited

U.S. PATENT DOCUMENTS 3,220,773 A * 11/1965 Burns
4,392,436 A * 7/1983 Weiler
4,845,915 A * 7/1989 Rogers et al.
4,974,526 A * 12/1990 Wiygul, Jr.
5,345,882 A * 9/1994 Yamada
5,381,758 A * 1/1995 Simon
5,660,122 A * 8/1997 Sickles et al. ..... 108/193
6,101,954 A * 8/2000 Rein et al. ..... 108/156 X
6,267,111 B1 * 7/2001 Burton ..... 108/156

* cited by examiner

*Primary Examiner*—Jose V. Chen
(74) *Attorney, Agent, or Firm*—Harness, Dickey & Pierce, PLC

(57) ABSTRACT

A modular base for a machine includes a tabletop, and four leg posts. The tabletop has a top side, a bottom side, and four post bores formed in the bottom side and arranged to form four corners of a rectangle. Each of the leg posts has an upper end portion inserted removably into a respective one of the post bores, and is provided with a pair of upper board engaging members and a pair of lower board engaging members, which are disposed at right angles and are adjacent to upper and lower end portions of the respective leg post. Each of the upper board engaging members forms a downwardly opening notch. Each of the lower board engaging members forms an upwardly opening notch. Four screw fasteners are disposed to fasten removably the upper end portions of the leg posts to the tabletop. Four rectangular board members are respectively disposed to extend across an adjacent pair of the leg posts. Each of the board members has first and second upper corner portions engaging respectively the notches in the upper board engaging members on the adjacent pair of leg posts, and first and second lower corner portions engaging respectively the notches in the lower board engaging members on the adjacent pair of leg posts.

5 Claims, 5 Drawing Sheets

MODULAR BASE FOR A MACHINE

BACKGROUND OF THE INVENTION

1. Field of the Invention

The invention relates to a modular base for a machine, more particularly to a modular base for a labeling machine which occupies a relatively small space and which can be assembled with relative ease.

2. Description of the Related Art

Commodities, such as beverage bottles, drug bottles, containers, and packaging boxes, are generally provided with a label to classify products, to indicate usage and other information, to display the trademark or logo of the manufacturer, etc. With the recent advancement in automation, automated attachment of labels to such commodities has taken the place of manual label attachment, and has become quite popular in the industry.

In a conventional label attaching process, a reel of labels including a backing paper strip and a plurality of labels is arranged on a reel support plate. A leading end of the reel is drawn via a guiding device to a label applicator plate where the labels are applied to containers being advanced by a container conveyer.

With reference to FIG. 1, a conventional base 1 is adapted for use with a labeling machine that includes a conveyor unit 2, a label applying unit 3, a label pressing unit 4, a baffle plate member 5, and an electrical box 6. The conventional base 1 is shown to include a tabletop 102 and four side plates 101. In general, the tabletop 102 and the side plates 101 are mounted on a frame of steel (not shown) that is formed by casting or from steel plates welded together or fastened together by screw fasteners. As such, high precision is required in forming the base 1. Besides, the base 1 is bulky and occupies a large amount of space.

SUMMARY OF THE INVENTION

Therefore, the main object of the present invention is to provide a modular base for a machine, which is easy to assemble and dismantle.

Accordingly, a modular base of this invention includes a tabletop, four leg posts, four screw fasteners, and four rectangular board members. The tabletop has a top side, a bottom side opposite to the top side in a vertical direction, and four post bores formed in the bottom side and arranged to form four corners of a rectangle. Each of the leg posts has an upper end portion inserted removably into a respective one of the post bores, and a lower end portion. Each of the leg posts is provided with a pair of radially extending upper board engaging members that are disposed at right angles and that are adjacent to the upper end portion, and a pair of radially extending lower board engaging members that are disposed at right angles and that are adjacent to the lower end portion. Each of the upper board engaging members forms a downwardly opening notch. Each of the lower board engaging members forms an upwardly opening notch. Each of the screw fasteners fastens removably the upper end portion of a respective one of the leg posts to the tabletop. Each of the board members extends across an adjacent pair of the leg posts, and has first and second upper corner portions, and first and second lower corner portions. The first upper corner portion engages removably the notch in one of the upper board engaging members on one of the adjacent pair of leg posts. The first lower corner portion engages removably the notch in one of the lower board engaging members on said one of the adjacent pair of leg posts. The second upper corner portion engages removably the notch in one of the upper board engaging members on the other one of the adjacent pair of leg posts. The second lower corner portion engages removably the notch in one of the lower board engaging members on the other one of the adjacent pair of leg posts.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
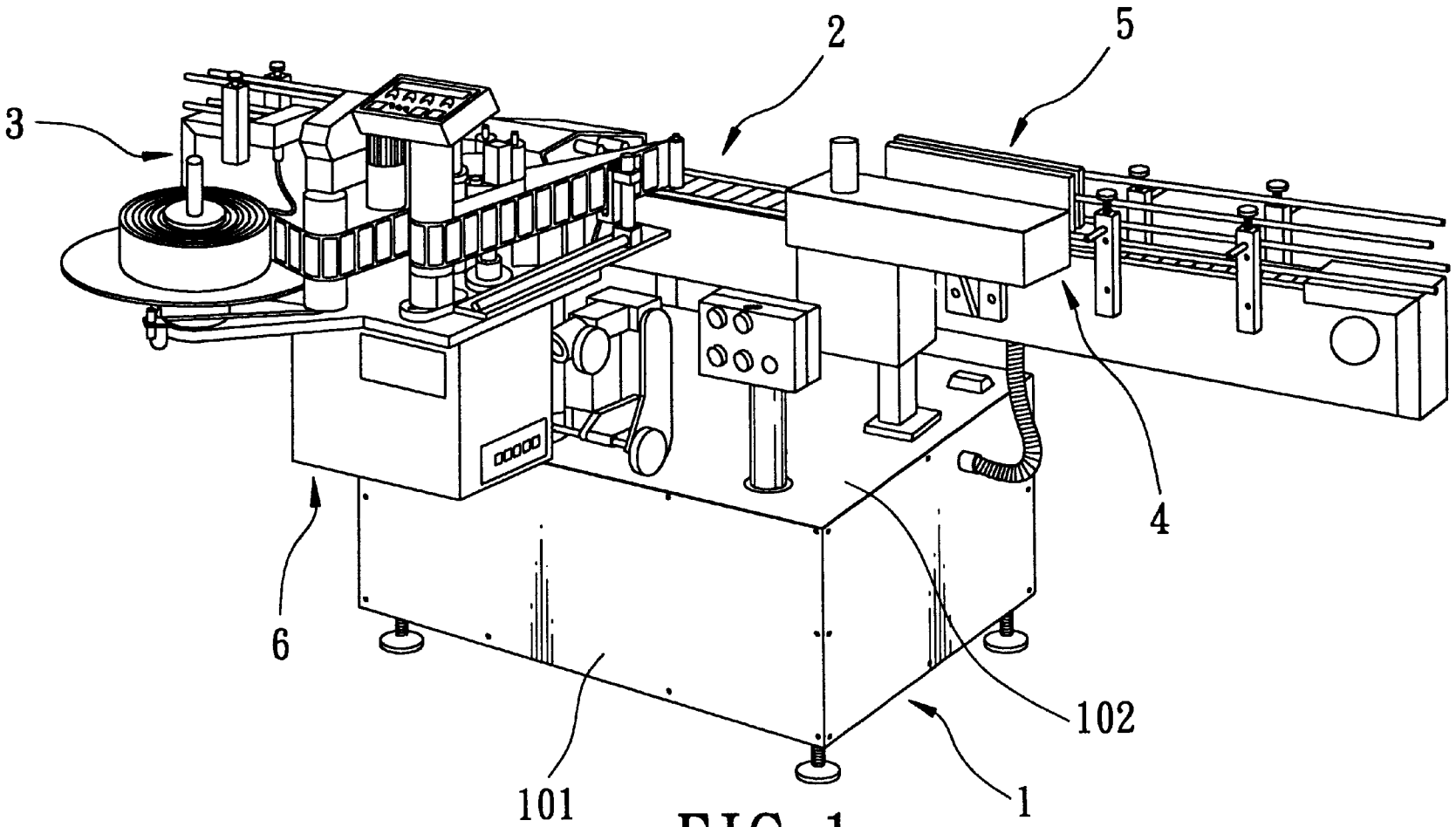
FIG. 1 PRIOR ART
FIG. 1 is a perspective view of a conventional labeling machine with a conventional base.
Figure 2:
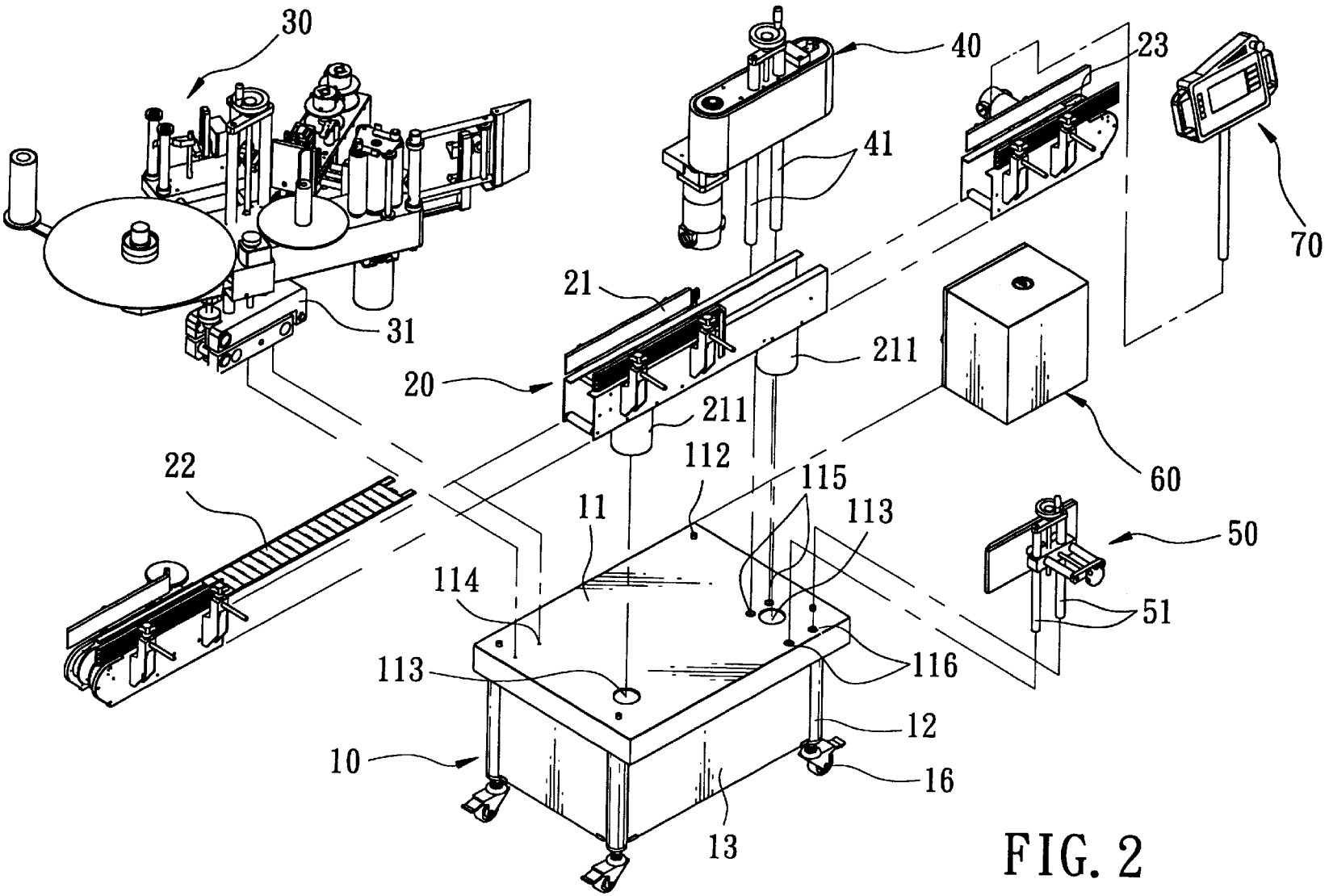
FIG. 2 is an exploded perspective view of a labeling machine to be mounted on the preferred embodiment of a modular base according to the invention.
Figure 3:
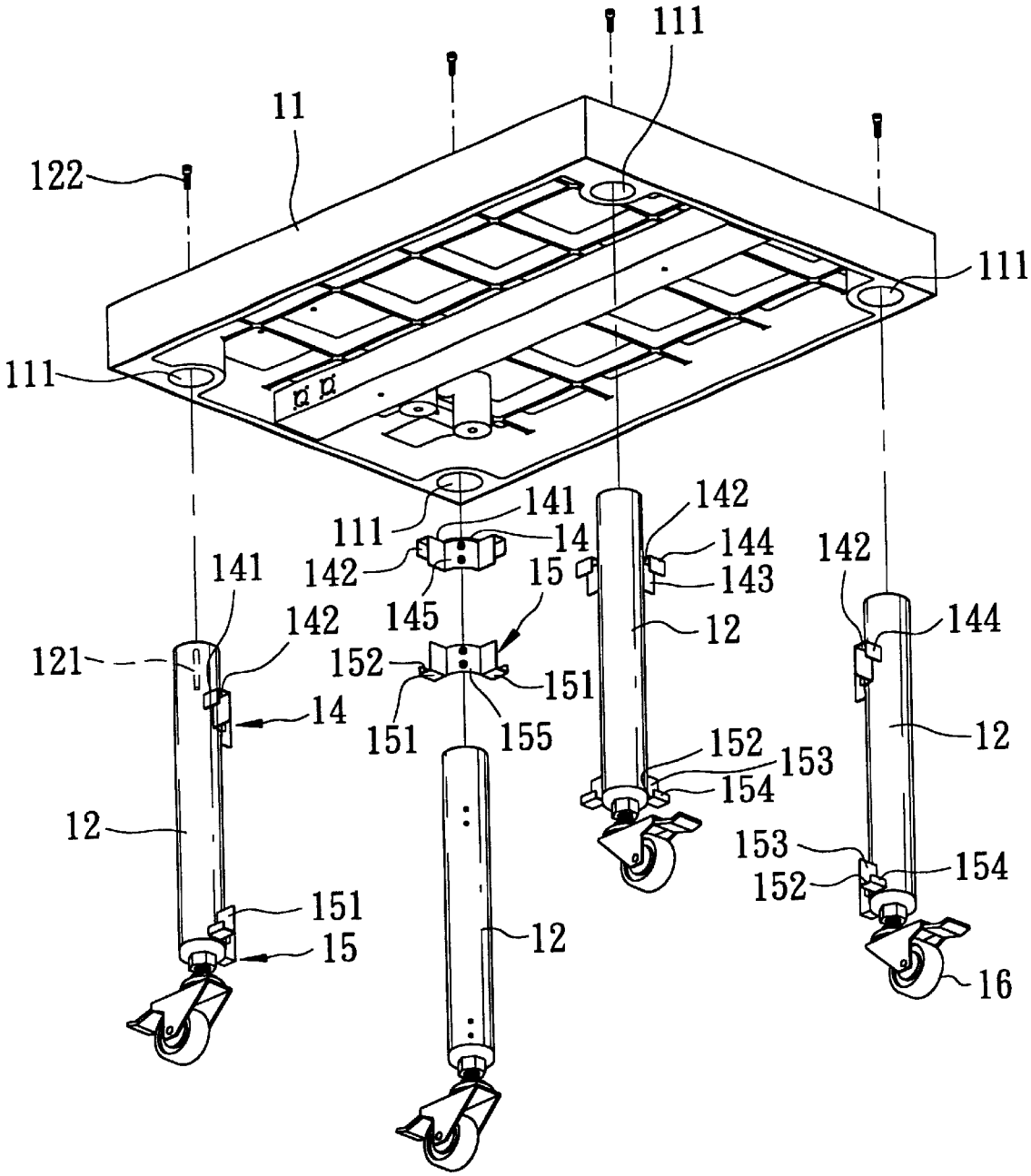
FIG. 3 is a fragmentary exploded perspective view of the preferred embodiment.
Figures 4A, 4B, 4C:
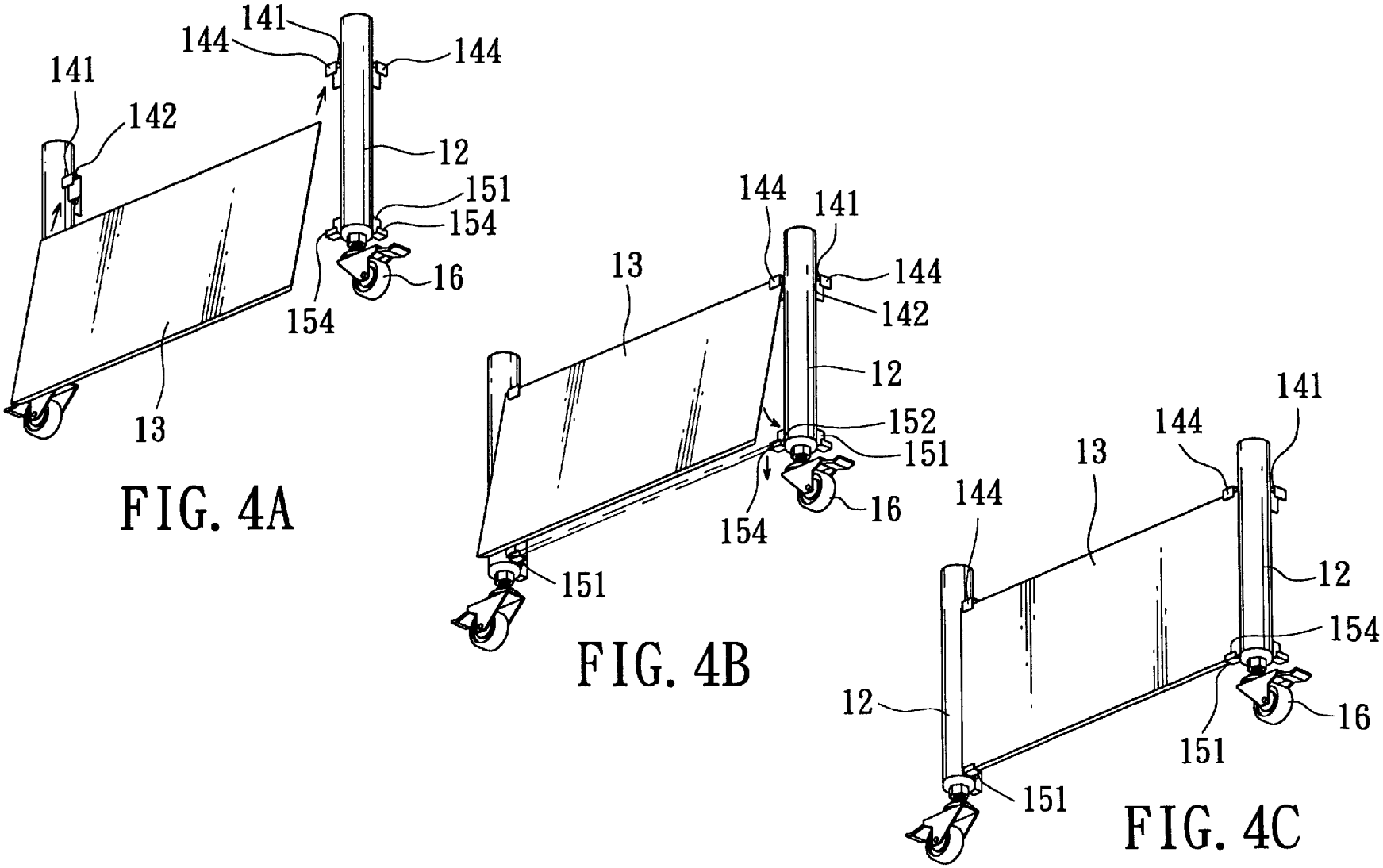
FIGS. 4A to 4C are schematic perspective views illustrating how a board member is assembled to leg posts of the modular base of the present invention.

Referring to FIGS. 2, 3, 4A, 4B and 4C, the preferred embodiment of a modular base 10 for a machine according to the present invention is shown to include a tabletop 11, four leg posts 12, four screw fasteners 122, and four rectangular board members 13.

In this embodiment, the modular base 10 is adapted for use with a labeling machine that includes a conveyor unit 20 with front, intermediate and rear conveyor sections 23, 21, 22, a label applying unit 30, a label pressing unit 40, a baffle plate member 50, an electrical box 60, and an operating box 70. The tabletop 11 has a top side, a bottom side opposite to the top side in a vertical direction, and four post bores 111 formed in the bottom side and arranged to form four corners of a rectangle. The top side of the tabletop 11 is formed with four fastener holes 112 communicated with the post bores 111, respectively. Lower left and right insert holes 113 are respectively formed in the top side of the tabletop 11 adjacent to the lower left and right ones of the four fastener holes 112, and are adapted for mounting two insert portions 211 of the intermediate conveyor section 21. Two locking holes 114 are formed in the top side near the upper left one of the four fastener holes 112, and are adapted for mounting a securing seat 31 of the label applying unit 30. Two pairs of mounting holes 115, 116 are respectively formed in the top side adjacent to the lower right insert hole 113, and are adapted for mounting two mounting rods 41 of the label pressing unit 40 and two mounting rods 51 of the baffle plate member 50, respectively. The electrical box 60 is secured on the top side at an upper right portion of the tabletop 11. The operating box 70 is locked onto one side of the conveyor unit 20.

Each of the leg posts 12 has an upper end portion inserted removably into a respective one of the post bores 111 and formed with an axially extending screw hole 121, and a lower end portion provided with a wheel unit 16. Each of the leg posts 12 is provided with upper and lower board engaging units 14, 15 that are respectively disposed adjacent to the upper and lower end portions. The upper board engaging unit 14 includes a pair of radially extending upper board engaging members 141 that are disposed at right angles, and a curved connecting portion 145 that connects the upper board engaging members 141 and that abuts against and that is mounted on the respective leg post 12 through the use of screw fasteners. Each of the upper board engaging members 141 forms a downwardly opening notch 142, and has a generally inverted L-shaped cross-section. Furthermore, each of the upper board engaging members 141 is formed as a resilient metal plate having opposite first and second notch-defining walls 143, 144 of different lengths that extend in the vertical direction, and a third notch-defining wall that interconnects the first and second notch-defining walls 143, 144. In this embodiment, the first notch-defining wall 143 is longer than the second notch-defining wall 144. The lower board engaging unit 15 includes a pair of radially extending lower board engaging members 151 that are disposed at right angles, and a curved connecting portion 155 that connects the lower board engaging members 151 and that abuts against and that is mounted on the respective leg post 12 through the use of screw fasteners. Each of the lower board engaging members 151 forms an upwardly opening notch 152, and has a generally L-shaped cross-section. Furthermore, each of the lower board engaging members 151 is formed as a resilient metal plate having opposite first and second notch-defining walls 153, 154 of different lengths that extend in the vertical direction, and a third notch-defining wall that interconnects the first and second notch-defining walls 153, 154. In this embodiment, the first notch-defining wall 153 is longer than the second notch-defining wall 154. In addition, the second notch-defining wall 144 of each of the upper board engaging members 14 is longer than the second notch-defining wall 154 of each of the lower board engaging members 15 so as to facilitate mounting of the board members 13. The distance between the third notch-defining walls of the upper and lower board engaging members 141, 151 is equal to the height of each board member 13.

Each of the screw fasteners 122 fastens removably the upper end portion of a respective one of the leg posts 12 to the tabletop 11. Each of the screw fasteners 122 extends through one of the fastener holes 112 and engages threadedly the screw hole 121 in the respective one of the leg posts 12.

Each of the board members 13 extends across an adjacent pair of the leg posts 12, and has first upper and lower corner portions, and second upper and lower corner portions. The first upper corner portion engages removably the notch 142 in one of the upper board engaging members 141 on one of the adjacent pair of the leg posts 12. The first lower corner portion engages removably the notch 152 in one of the lower board engaging members 151 on the one of the adjacent pair of the leg posts 12. The second upper corner portion engages removably the notch 142 in one of the upper board engaging members 141 on the other one of the adjacent pair of the leg posts 12. The second lower corner portion engages removably the notch 152 in one of the lower board engaging members 151 on the other one of the adjacent pair of the leg posts 12.

Assembly of the modular base 10 of this invention will now be described with reference to FIGS. 2 to 5. Initially, the upper end portions of the four leg posts 12 are respectively inserted into the four post bores 111 in the bottom side of the tabletop 11. Then, the screw fasteners 122 are extended through the fastener holes 112 to engage threadedly the screw holes 121 in the upper end portions of the leg posts 12 to thereby secure the tabletop 11 firmly on the four leg posts 12. Next, the first and second upper corner portions of one of the board members 13 are respectively inserted into the notches 142 in the upper board engaging members 141 on an adjacent pair of leg posts 12 such that an upper portion of said one of the board members 13 is limited by the second notch-defining walls 144 of the upper board engaging members 141. Then, the first and second lower corner portions of said one of the board members 13 are respectively inserted into the notches 152 in the lower board engaging members 151 on the adjacent pair of leg posts 12 by virtue of the resilience of the second notch-defining walls 154 of the lower board engaging members 151, which are pushed by said one of the board members 13 to increase the distance between the second notch-defining walls 144, 154 of the upper and lower board engaging members 141, 151. Thereafter, the second notch-defining walls 154 of the lower board engaging members 151 will resume their original positions and serve to retain the first and second lower corner portions of said one of the board members 13 in the notches 152 in the lower board engaging members 151. All of the four board members 13 are mounted across the leg posts 12 in the above-described manner to complete assembly of the modular base 10.

Figure 5:
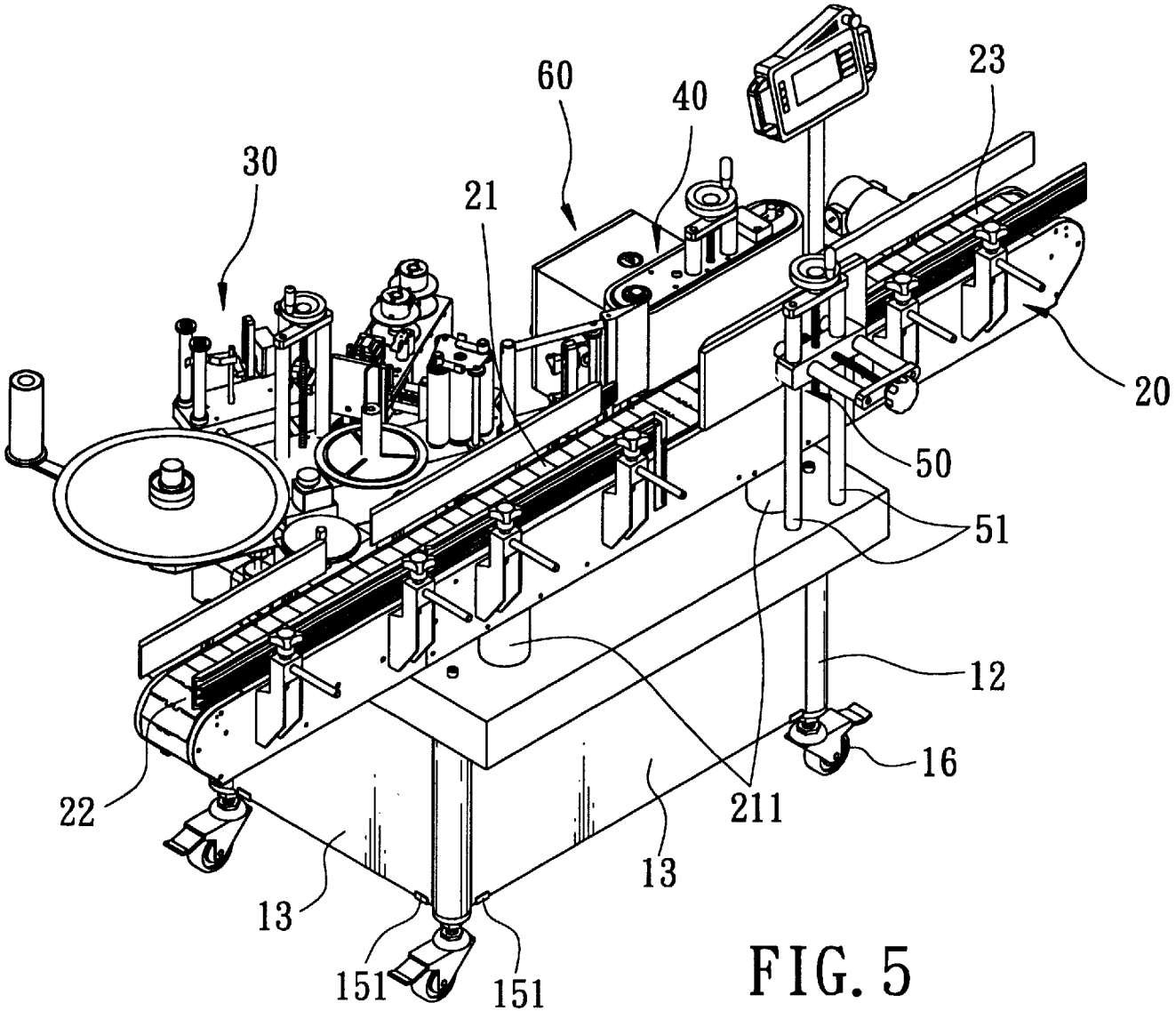
FIG. 5 is a perspective view of the labeling machine mounted on the preferred embodiment.

By virtue of the construction of the modular base 10 of the invention, the modular base 10 can be delivered in a dismantled state ex-factory to facilitate transport and save space, and can be assembled conveniently and quickly by the user on site. In addition, the components, namely, the conveyor unit 20, the label applying unit 30, the label pressing unit 40, the baffle plate member 50, the electrical box 60, and the operating box 70 can be conveniently mounted on the top side of the tabletop 11 of the modular base 10, as best shown in FIG. 5.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A modular base, comprising:

a tabletop having a top side, a bottom side opposite to said top side in a vertical direction, and four post bores formed in said bottom side and arranged to form four corners of a rectangle;

four leg posts, each of which has an upper end portion inserted removably into a respective one of said post bores, and a lower end portion, each of said leg posts being provided with a pair of radially extending upper board engaging members that are disposed at right angles with respect to said leg posts and that are adjacent to said upper end portion, and a pair of radially extending lower board engaging members that are disposed at right angles with respect to said leg posts and that are adjacent to said lower end portion, each of said upper board engaging members forming a downwardly opening notch, each of said lower board engaging members forming an upwardly opening notch;

four screw fasteners, each of which fastens removably said upper end portion of a respective one of said leg posts to said tabletop; and four rectangular board members, each of which extends across an adjacent pair of said leg posts, and has a first upper corner portion that engages removably said notch in one of said upper board engaging members on one of said adjacent pair of said leg posts, a first lower corner portion that engages removably said notch in one of said lower board engaging members on said one of said adjacent pair of said leg posts, a second upper corner portion that engages removably said notch in one of said upper board engaging members on the other one of said adjacent pair of said leg posts, and a second lower corner portion that engages removably said notch in one of said lower board engaging members on the other one of said adjacent pair of said leg posts.

2. The modular base of claim 1, wherein each of said upper board engaging members has a generally inverted L-shaped cross-section, and each of said lower board engaging members has a generally L-shaped cross-section.

3. The modular base of claim 2, wherein each of said upper and lower board engaging members is formed as a resilient metal plate having opposite first and second notch-defining walls that extend in the vertical direction, and a third notch-defining wall that interconnects said first and second notch-defining walls, one of said first and second notch-defining walls being longer than the other.

4. The modular base of claim 1, wherein:

said top side of said tabletop is formed with four fastener holes communicated with said post bores, respectively;

said upper end portion of each of said leg posts is formed with an axially extending screw hole; and each of said screw fasteners extends through one of said fastener holes and engages threadedly said screw hole in the respective one of said leg posts.

5. The modular base of claim 1, wherein said lower end portion of each of said leg posts is provided with a wheel unit.

* * * * *